US008552616B2

(12) United States Patent
Prelas

(10) Patent No.: US 8,552,616 B2
(45) Date of Patent: Oct. 8, 2013

(54) MICRO-SCALE POWER SOURCE

(75) Inventor: Mark A. Prelas, Columbia, MO (US)

(73) Assignee: The Curators of the University of Missouri, Columbia, MO (US)

( * ) Notice: Subject to any disclaimer, the term of this patent is extended or adjusted under 35 U.S.C. 154(b) by 775 days.

(21) Appl. No.: 12/086,219

(22) PCT Filed: Oct. 25, 2006

(86) PCT No.: PCT/US2006/041447

§ 371 (c)(1),
(2), (4) Date: Aug. 1, 2008

(87) PCT Pub. No.: WO2008/051216

PCT Pub. Date: May 2, 2008

(65) Prior Publication Data

US 2009/0026879 A1 Jan. 29, 2009

Related U.S. Application Data

(60) Provisional application No. 60/730,092, filed on Oct. 25, 2005.

(51) Int. Cl.
*G21H 1/06* (2006.01)
*G21H 1/00* (2006.01)

(52) U.S. Cl.
USPC ..... 310/303; 136/253; 438/56; 257/E21.12

(58) Field of Classification Search
USPC ..... 310/303; 136/253
See application file for complete search history.

(56) References Cited

U.S. PATENT DOCUMENTS

| | | | | | |
|---|---|---|---|---|---|
| 3,053,926 | A | * | 9/1962 | Ben-Sira et al. | 136/256 |
| 3,714,474 | A | | 1/1973 | Hoff, Jr. | |
| 4,024,420 | A | * | 5/1977 | Anthony et al. | 310/303 |
| 4,053,925 | A | * | 10/1977 | Burr et al. | 257/376 |
| 4,247,862 | A | * | 1/1981 | Klein | 257/297 |
| 4,506,436 | A | * | 3/1985 | Bakeman et al. | 438/449 |
| H569 | H | * | 1/1989 | Varker et al. | 257/297 |
| 4,875,084 | A | * | 10/1989 | Tohyama | 257/436 |
| 5,082,505 | A | * | 1/1992 | Cota et al. | 136/253 |
| 5,198,371 | A | * | 3/1993 | Li | 438/475 |
| 5,389,434 | A | * | 2/1995 | Chamberlain et al. | 428/323 |
| 5,396,141 | A | * | 3/1995 | Jantz et al. | 310/303 |

(Continued)

FOREIGN PATENT DOCUMENTS

| | | | |
|---|---|---|---|
| WO | 99-21232 | * | 4/1999 |
| WO | 99/36767 | | 7/1999 |

OTHER PUBLICATIONS

L.C.Olsen, "Review of Betavoltaic Energy Conversion", pp. 256-267, NASA AN94-11407/1, May 1993.*

(Continued)

*Primary Examiner* — Burton Mullins
(74) *Attorney, Agent, or Firm* — Greer, Burns & Crain Ltd.

(57) ABSTRACT

A micro-scale power source and method includes a semiconductor structure having an n-type semiconductor region, a p-type semiconductor region and a p-n junction. A radioisotope provides energy to the p-n junction resulting in electron-hole pairs being formed in the n-type semiconductor region and p-type semiconductor region, which causes electrical current to pass through p-n junction and produce electrical power.

15 Claims, 5 Drawing Sheets

(56) References Cited

U.S. PATENT DOCUMENTS

| | | | | |
|---|---|---|---|---|
| 5,443,657 | A * | 8/1995 | Rivenburg et al. | 136/253 |
| 5,508,211 | A * | 4/1996 | Yee et al. | 438/400 |
| 5,759,904 | A * | 6/1998 | Dearnaley | 438/528 |
| 5,900,652 | A * | 5/1999 | Battaglia et al. | 257/135 |
| 5,985,688 | A * | 11/1999 | Bruel | 438/53 |
| 6,238,812 | B1 * | 5/2001 | Brown et al. | 429/5 |
| 6,656,822 | B2 * | 12/2003 | Doyle et al. | 438/523 |
| 6,690,074 | B1 * | 2/2004 | Dierickx et al. | 257/398 |
| 6,753,469 | B1 * | 6/2004 | Kolawa et al. | 136/253 |
| 6,774,531 | B1 | 8/2004 | Gadeken | |
| 6,808,967 | B1 * | 10/2004 | Aspar et al. | 438/162 |
| 7,022,544 | B2 * | 4/2006 | Cohen et al. | 438/57 |
| 7,166,524 | B2 * | 1/2007 | Al-Bayati et al. | 438/530 |
| 7,326,597 | B2 * | 2/2008 | Forbes et al. | 438/143 |
| 7,488,889 | B2 * | 2/2009 | Putnam | 136/253 |
| 7,501,631 | B2 * | 3/2009 | Mandelkern et al. | 250/361 R |
| 7,605,443 | B2 * | 10/2009 | Ogura | 257/522 |
| 8,073,097 | B2 * | 12/2011 | Tsang et al. | 376/320 |
| 2005/0082942 | A1 * | 4/2005 | Shirley | 310/303 |
| 2005/0231064 | A1 * | 10/2005 | Raffaelle et al. | 310/303 |

OTHER PUBLICATIONS

V. Raineri et al. "Radiation damage and implanted He atom interaction during void formation in silicon", Appl.Phys.Lett. 71 (12), pp. 1673-1675, Sep. 1997.*

G.A. Hishmeh et al. "Rare gas bubbles in muscovite mica implanted with xenon and krypton", Journal of Materials Research, vol. 9, Issue 12, pp. 3095-3107, Dec. 1994.*

A. H. Kahn, M. F. Odeh, J. Meese, E. M. Charlson, E. J. Charlson, T. Stacy, G. Popovici, M. Prelas, J. L. Wragg, "Growth of Oriented Aluminum Nitride Films on Si by Chemical Vapor Deposition," J. Materials Science, 29. 4314-4318 (1994).

Blanchard, J.P., Henderson, D.L., Lal, A., Li, H., Guo, H., and Santanam, A. "Radioisotope Power for MEMS Devices", Transactions of the American Nuclear Society, 86, Jun. 10-13, 2002, 186.

Brown, Paul M., "Tritiated Amorphous Silicon Power Cells," 1998 Institute for New Energy Symposium, Salt Lake City, Utah (Aug. 14-15, 1998), pp. 33-37.

C. J. Keavney, R.J. Walters, and P. J. Drevinsky., Optimizing the radiation resistance of InP solar cells: Effect of dopant density and cell thickness., J. Appl. Phys. 73(1) 60 (Jan. 1, 1993).

F. P. Boody and M. A. Prelas, "Transient Radiation-Induced Absorption in Fused-Silica Optical Fibers, 400-950 nm," Proceedings of Specialist Conference on Physics of Nuclear Induced Plasmas and Problems of Nuclear-Pumped Lasers, Institute of Physics and Power Engineering, Obninsk, USSR (May 26-28, 1992).

Kosteski, T., N. P. Kherani, F. Saspari, S. Zukotynski, W. T. Shmayda, "Triatiated amorphous silicoin films and devices," Journal of Vacuum Science & Technology A—Vacuum Surfaces & Films. (1998) 16(2), 893-896.

M. A. Prelas, F. P. Boody, J. F. Kunze, and G. H. Miley, "Nuclear-Driven Flashlamps", Lasers and Particle Beams, 6(1), 25-55,(1988).

M. Hajsaid, E. J. Charlson, E. M. Charlson, G. Zhao, J. Meese, T. Stacy, G. Popovici, and M. Prelas, "High quantum efficiency for Pt2Si Schottky-barrier diodes in the vacuum ultraviolet," J. Appl. Phys., 75 (11), 7588-7590 (1994).

M. Prelas, E. J. Charlson, E. M. Charlson, J. Meese, G. Popovici, and T. Stacy, "Diamond Photovoltaic Energy Conversion," Second International Conference on the Applications of Diamond Films and Related Materials, Editors M. Yoshikawa, M. Murakawa, Y. Tzeng and W. A. Yarbrough, Myu Tokyo, pp. 5-12 (1993).

M. Prelas, T. Ghosh and R. Tompson, "Direct Conversion of Radioisotope Energy to Electricity:" Year 3 Report for DOE contract, DE FG07-001D13927, Aug. 2003.

Masafumi Yamaguchi, Stephen J. Taylor, Sumio Matsuda, and Osamu Kawasaki, "Mechanism for the anomalous degradation of Si solar cells induced by high fluence 1 MeV electron irradiation," Appl. Phys. Lett. 68(22) 3141 (May 27, 1996).

Mitsuru Imaizumi, Stephen J. Taylor, Masafumi Yamaguchi, Tadashi Ito, Tadashi Hisamatsu, and Sumio Matsuda., "Analysis of structure change of Si solar cells irradiated with high fluence electrons.," J. Appl. Phys. 85(3) 1916 (Feb. 1, 1999).

Physics of Radiation Effects in Crystals, eds. R. A. Johnson and A. N. Orlov, North-Holland, New York, 1986, pp. 197-199.

R. F. Davis, "Nitrides for Electronic and Optoelectonic Applications," Proc. IEEE, 79(5), pp. 702-712 (1991).

R. J. Walters and G. P. Summers, "Deep level transient spectroscopy study of proton irradiated p-type InP.," ,J. Appl. Phys. 69(9) 6488-6494, (May 1, 1991).

Robert J. Walters, S. R. Messenger, G. P. Summers, M. J. Romero, M. M. Al-Jassim, D. Araújo, and R. Garcia, "Radiation response of n-type base InP solar cells," J. Appl. Phys. 90(7) pp. 3558-3565, (Oct. 1, 2001).

S. J. Taylor, M. Yamaguchi, M. Yang, M. Imaizumi, S. Matsuda, O. Kawasaki, and T. Hisamatsu,"Type conversion in irradiated silicon diodes," Appl. Phys. Lett. 70, pp. 2165-2167 (1997).

S. Khasawinah, J. Farmer, M. Prelas, G. Popovici, "Neutron Irradiation and Annealing of 10-B Doped Chemical Vapor Deposited Diamond Films," MS 325, Proceedings of ADC, 1995, pp. 2523-2530.

S. R. Messenger, E. M. Jackson, E. A. Burke, R. J. Walters, M. A. Xapsos, and G. P. Summers, "Structural changes in InP/Si solar cells following irradiation with protons to very high fluences," J. Appl. Phys. 86(3) pp. 1230-1235, (Aug. 1, 1999).

S. Strite and H. Morkoc, J. Vac. Sci. Technol. B, 10(4), pp. 1237-1266 (1992).

S. Yoshida, S. Misawa and S. Gonda, "Properties of $Al_xGa_{1-x}N$ films prepared by reactive molecular beam epitaxy," J. Appl. Phys., 53(10), pp. 6844-6848 (1982).

S. Zh. Karazhanov, "Effect of radiation-induced defects on silicon solar cells," J. Appl. Phys. 88(7) 3941-3947 (Oct. 1, 2000).

Spitsyn A.B., Chernykh K.Yu., Belyanin A.F., Spitsyn B.V., Prelas M.A., Tompson R.V., Ghosh T.K. "CVD of AlN, GaN and their solid solution using precursors containing all of the necessary components for the synthesis," Proceedings of 5-th International Symposium on Diamond Films and Related Materials. Ed.: V.I.Lapshin, M.A.Prelas, V.M.Shulaev and B.V.Spitsyn. Kharkov. Ukraine. 2002. p. 248-252.

T. Tanaka, A. Watanabe, H. Amano, Y. Kobayashi, I. Akasaki, S. Yamazaki and M. Koike,"p-type conduction in Mg-doped GaN and $A1_{0.08}Ga_{0.92}N$ grown by metalorganic vaor phase epitaxy," Appl. Phys. Lett., 65(5), pp. 593-594 (1994).

Feng, Z.C., Shih, A., and Miller, W.H., "Self-excited oscillations of structures by particle emission", Nonlinear Dynamics, 32, 2003, pp. 15-32.

Polyakov, V.I., Rukovishnikov, A.I., Khomich, A.V., Druz, B.L. ,Kania, D., Hayes, A., Prelas, M.A., Tompson, R.V., Ghosh, T.K., Loyalka, S.K., "Surface Phenomena of the Thin Diamond-Like Carbon Films," Mat. Research Symp. Proc., Vo. 555, 1999, pp. 345-350.

Boody, Frederick P., Prelas, Mark A., "Absolutely Calibrated Spectra of Nuclear-Driven Rare Gases, 400-950 nm," Proceedings of Specialist Conference on Physics of Nuclear Induced Plasmas and Problems of Nuclear-Pumped Lasers, vol. 2, 1993, pp. 149-155.

Spitsyn et al., "Impurity Removal from 6H-SiC Using Field Enhanced Diffusion of Optical Activation Method," Journal of Wide Bandgap Materials, vol. 10, No. 2, Oct. 2002, pp. 149-159.

Spitsyn et al., "Charge Carriers Removal from 4H-CiC Using Field Enhanced by Optical Activation Diffusion Method," Journal of Wide Bandgap Materials, vol. 10, No. 2, Oct. 2002, pp. 89-98.

Brown, Paul M., "Betavoltaic Bateries," Journal of New energy, vol. 5, No. 4, 2001, pp. 35-42.

Khasawinah et al., "Neutron Irradiation and Annealing of $^{10}B$ Doped Chemical Vapor Deposited Diamond Films," Journal of Material Resources, vol. 10, No. 10, Oct. 1995, pp. 1-8.

Popovici et al., "Diamond Ultraviolet Photovoltaic Cell Obtained by Lithium and Boron Doping," Journal of Applied Physics, 81(5), Mar. 1, 1997, pp. 2429-2431.

Journal of New Energy, vol. 3, No. 2/3, Proceedings of the INE Symposium on New Energy, Aug. 14-15, 1998.

* cited by examiner

Raman spectrum of sample 133

MICRO-SCALE POWER SOURCE

PRIORITY CLAIM AND REFERENCE TO RELATED APPLICATION

The present application claims the benefit of U.S. Provisional Patent Application No. 60/730,092, filed Oct. 25, 2005.

FIELD OF THE INVENTION

The field of the invention is power sources. Another field of the invention includes self-contained and/or portable devices requiring a power source. Particular exemplary applications of the invention include, for example, microelectromechanical systems (MEMS), portable electronics, military devices, and spacecraft.

BACKGROUND ART

In countless modern devices, power supply remains a significant hurdle to further advancement and utility of the state of the art. Many electronic barriers have been broken. Many size barriers have been broken. Self-contained and/or portable devices requiring energy for operation continue to be limited by a relatively lagging state of technological development of power sources. In any number of devices ranging from detection equipment to laptop computers, the power source is primary limitation on continuous operation. In many instances, the power supply also dwarfs the complicated electronics, displays, interfaces and other portions of a given device.

One particularly important field is that of microelectromechanical systems (MEMS). MEMS technology has introduced miniaturization of military and civilian systems. MEMS devices have micromechanical portions that provide important functionality and permit integration with electronics. Such miniaturization offers greatly improved portability and mobility. This in turn translates to reduced invasiveness in countless applications, including for example, diagnostic systems. MEMS also significantly reduced costs in space explorations. However, a fully miniaturized system requires a similarly miniaturized power source.

DISCLOSURE OF INVENTION

The present invention overcomes many of the problems associated with known power source systems, and provides a method of generating electrical power in a miniaturized system. Advantageously, one embodiment of a self-contained power source is capable of being scaled such that the power source can be integrated with MEMS systems. Additionally, the present invention can generate power without using solar or generator-based power sources.

An embodiment of the present invention is a power source that uses energy from radioisotopes to energize a p-n junction of a semiconductor structure that is formed of an n-type semiconductor material and a p-type semiconductor material, which in turn generates electricity. The semiconductor structure may also use first and second contacts that are in contact with respective n- or p-type semiconductor materials and are separated from each other by the p-n junction. The contacts enable electric current flow from the self-contained power source to other electronic circuitry connected to the power source.

In one embodiment of the invention, a self-contained power source includes a p-n junction of wide band-gap materials. A radioisotope provides energy to the p-n junction of the wide band-gap materials. The radioisotope can be formed as a thin layer coating on an n-type semiconductor material, with the n-type semiconductor material forming a junction at some depth with a p-type semiconductor material. A protective coating can be formed over the radioisotope, and a cover can be provided on the protective coating. To facilitate electric current flow to other electrical systems, first and second contacts can be connected to the n- and p-type materials forming the p-n junction.

In another embodiment, a micro-scale power source can include a semiconductor structure having a p-n junction formed of wide band-gap materials, and a radioisotope providing energy to the p-n junction. A radiation shield is located within the semiconductor structure. The radiation shield can comprise atoms implanted within a small volume of the semiconductor structure to form a micro bubble. The atoms defining the micro bubble can be selected from materials designed to locally change the band-gap properties of the semiconductor structure, and functions to assist with shielding the semiconductor structure from radiation damage.

In another aspect of the invention, a method of forming a power source includes the steps of forming a semiconductor structure having a p-n junction of wide band-gap materials; implanting atoms in the semiconductor structure; and providing radioactive energy to the p-n junction, wherein the implanted atoms are excited to produce photons in a micro bubble that changes band-gap properties of the semiconductor structure. The photons produced in the micro bubble impinge upon the p-n junction to thereby generate electrical power.

BRIEF DESCRIPTION OF DRAWINGS

The invention and its modes of use and advantages are best understood by reference to the following description and illustrative embodiments when read in conjunction with the accompanying drawings, wherein.

BEST MODE OF CARRYING OUT THE INVENTION

Figure 1A:
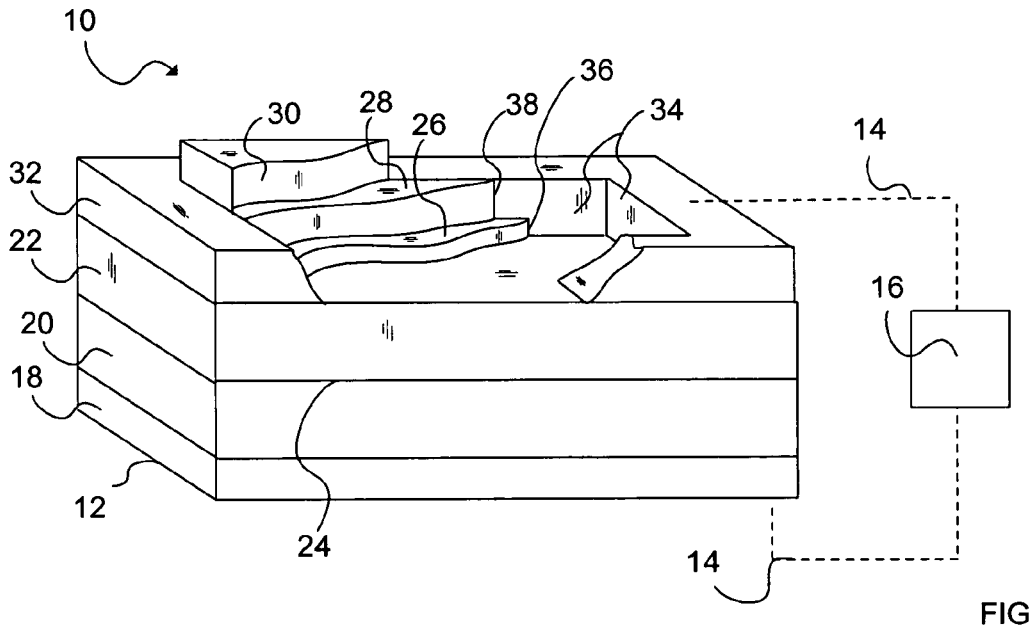
FIG. 1A is a perspective view, partially cut-away and illustrates one embodiment of a micro-scale power source.

The invention is directed to a micro-scale power source. Embodiments of the invention may be integrated, for example, with MEMS. With such embodiments of the invention, a preferred formation process combines fabrication of the power source with that of the microelectromechanical structures. A self-powered MEMS device is formed.

The micro-scale power source of the invention makes use of wide band-gap materials in a semiconductor structure, such as a betavoltaic structure or cell. An embodiment of the invention is a betavoltaic device in which radioactive decay produces charge in a p-n junction formed of wide band-gap materials (See, e.g. FIG. 1A).

Radioisotope power conversion uses energy from the decay of radioisotopes to generate electrical power. Advantageously, radioisotope power can be used for applications that are considered inappropriate when using other power sources, such as generators, batteries, and solar cells. Some appropriate applications for using radioisotope power generating systems include space, underwater, and biomedical environments.

The self-contained power source of the present invention is an electrical power source that includes n- and p-type semiconductor materials and at least one p-n junction within the semiconductor materials. A radioisotope (i.e. radioactive material) supplies energy to the p-n junction by emitting electrically-charged radioactive particles into the semiconductor materials near the p-n junction. The p-n junction receives the electrically-charged radioactive particles to generate electron-hole pairs therefrom and produce electrical current across the p-n junction. The self-contained power source of the present invention may use, for example, a radiation source that emits $\alpha$ radiation, $\beta$ minus or plus radiation, $\gamma$ radiation, or even fission fragments.

A technical advantage of the present invention is that it provides long-lived, inexpensive power for electrical circuits from a thin layer of radioactive material. Since the energy provided per radioactive particle is substantial, only a small amount of radioactive material is necessary to generate a large number of electron-hole pairs. The large number of electron-hole pairs produces electrical current across the p-n junction to power electronic circuitry. Additionally, one or more protection and shielding layers can be provided to prevent radiation emitted from the radioisotope from exiting the micro-scale power source and or electronic circuitry integrated with the power source.

Another technical advantage of the present invention is that ions can be implanted or formed in the semiconductor structure formed on n- and p-type materials to provide radiation shielding to the semiconductor structure. In this manner, local band-gap properties of the materials forming the p-n junction and semiconductor structure can be varied.

Yet another advantage of the present invention is that the power source can be formed in a variety of configurations depending on the power requirements of the electronic circuitry integrated with the power source. In one embodiment, a micro bubble can be utilized as a radiation shield. In other embodiments, no micro bubble may be used. Materials forming the n- and p-type semiconductor layers can vary depending upon the desired application. Radiation sources can also vary depending upon the semiconductor materials used to form the p-n junction, desired maximum power output from the power source, and selected type of $\alpha$, $\beta$, $\gamma$ or other radiation utilized to energize the p-n junction.

Figure 1B:
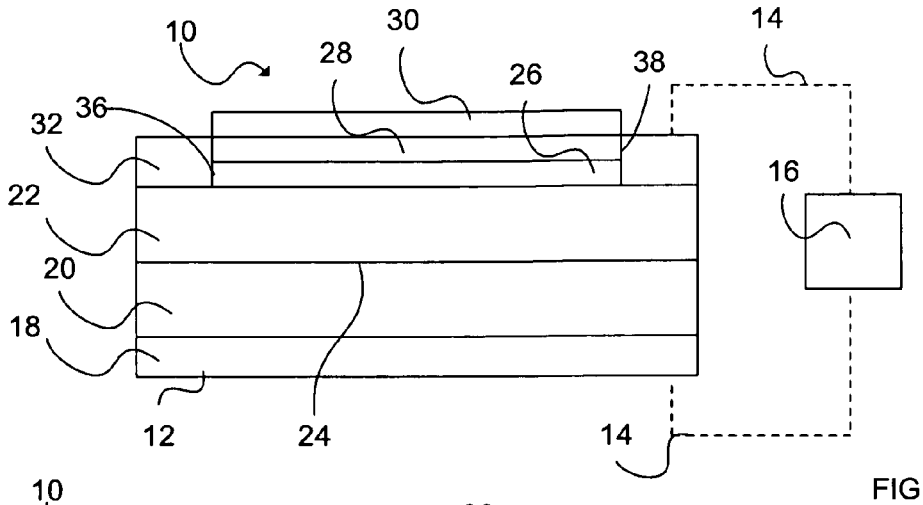
FIG. 1B is a cross-section of the semiconductor structure of FIG. 1A viewed along the lines B-B of FIG. 1C.
Figure 1C:
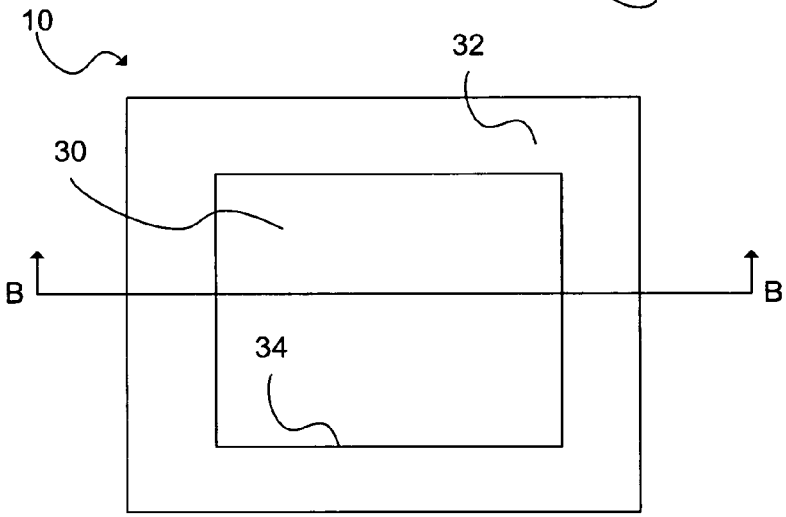
FIG. 1C is a top view of the semiconductor structure of FIG. 1A.

Generally, FIGS. 1A-C illustrate one preferred embodiment of a self-contained power source 10 of the present invention, which uses $\beta$ radiation. However, it is envisioned that other types of photovoltaic cells using $\alpha$, $\gamma$ and other types of radioactive energy can be implemented with the present invention. FIG. 1A is a perspective view with several layers partially cut away. The power source 10 is designed as a multilayer semiconductor structure 12 that is shown externally connected via a connection pattern formed as conductive lead lines 14 to electronic circuitry which has been illustrated in FIG. 1B as element 16 and which can be, for example, a MEMS system or other device or circuitry. FIG. 1C shows a top view of the semiconductor structure 12. A cross-sectional view of the semiconductor structure 12 of FIG. 1B is taken along lines B-B of FIG. 1C.

Although for facilitating understanding of the present invention the electronic circuitry represented schematically as element 16 and connection pattern 14 have been illustrated in FIG. 1B as being separate from the semiconductor structure 12, it will be appreciated that in some embodiments of the invention the semiconductor structure 12 can be integrated with the connection pattern 14 and circuitry 16 (which can be, for example, a MEMS system) to form a single integrated circuit, which can be located on, for example, a circuit board (not shown).

The semiconductor structure 12 includes a first contact or layer 18 (not shown in FIG. 1C) that has a p-type semiconductor layer 20 stacked thereon. An n-type semiconductor layer 22 is formed on the p-type semiconductor layer 20, to define a p-n junction 24. In some invention embodiments, the n-type semiconductor layer 22 and p-type semiconductor layer 20 are formed of wide band-gap materials. The wide band-gap materials used in some power sources of the invention are resistant to radiation damage, and generate a significant voltage potential. Advantageously, higher voltage potentials create more energy per radioactive decay. Suitable wide band-gap materials include aluminum nitride (AlN), diamond, gallium nitride (GaN), and silicon carbide (SiC). Other wide band gap materials are contemplated for practice of the invention, and will be known to those knowledgeable in the art.

It is also contemplated to form an n-p junction with junction being formed by the n-type semiconductor layer 22 and the p-type layer 20 with a conductive back layer 18. A radioisotope (e.g. beta source) 26 is formed as a layer on at least a portion of the n-type semiconductor layer 22. The radioisotope 26 has been shown as partially cutaway in FIG. 1A, but will be understood to extend across all the exposed surface of the layer 12 in FIG. 1A. A protective coating layer 28 is formed on the radioisotope 26 (also shown as cutaway for illustration) and prevents the radioisotope from being scratched or otherwise removed from the n-type semiconductor layer 22. A cover layer 30 (also shown as cutaway) is formed on the protective coating layer 28 and limits radiation from escaping the semiconductor structure 12.

A second contact or layer 32 is also formed on the n-type semiconductor layer 22 and surrounds the perimeter of the radioisotope 26 and the protective coating 28, as shown in FIGS. 1A and 1C. The second contact 32 also surrounds the perimeter of the protective coating 28 and has inner sidewalls 34 that are adjacent outer sidewalls 36 of the radioisotope 26 and outer sidewalls 38 of the protective coating 28. As shown in FIG. 1A, the cover layer 30 does not extend over the contact 32 to allow for maximum exposure of contact 32. Thus, the first and second contacts 18, 32 facilitate electrical current flow to the electronic circuitry 16.

Although the cover layer 30 is shown to extend above the second contact 32, it is contemplated that the layer thicknesses can be varied depending on the type of radioisotope and materials selected to form the semiconductor structure such the cover layer is co-planar with or within the void 40 formed by the second contact. Moreover, it is contemplated that in some embodiments the protective coating 28 and cover layer 30 can be combined as a single layer, or even completely eliminated such that the second contact 32 completely covers the radioisotope 26.

The power source 10 of FIG. 1 may be formed by depositing the n-type semiconductor layer 22 on the p-type semiconductor layer 20. The radioisotope 26 may be deposited on the n-type semiconductor layer 22 using a wide variety of techniques, including but not limited to, vapor deposition, sputtering, thin film deposition, electroplating, polymer bonding, and the like.

With reference to FIGS. 1A-C, the example embodiment power source has the semiconductor structure 12 formed as a betavoltaic cell. The radioisotope or layer 26 interfaces with a wide band-gap p-n junction 24. The p-n junction 24 absorbs radioactive decay from the radioisotope 26. Power is drawn from the potential created in the p-n junction 24 when an electrical contact is made between the first and second contacts 18, 32. While an external electrical circuitry 16 has been schematically illustrated in FIG. 1A as drawing power from the betavoltaic cell 12, it will be appreciated that electrical contact between the contacts 18 and 32 may be made through any of a wide variety of particular configurations. The contacts 18, 32 may, for example, be a configured as a connect pattern in an integrated circuit system where a device (not shown) in the integrated system draws power from the betavoltaic cell.

Accordingly, it will be appreciated that element 16 may represent an external electrical circuit such as a MEMS device, or may represent a MEMS device, an integrated circuit, or other circuitry of which the power source 10 is integral with. The second contact 32 in FIGS. 1A-C is shaped, for example, to substantially surround a perimeter of the radioisotope layer 26 and provide a large area of interface with the n-type semiconductor layer 22 of the p-n junction 24. The first contact is shaped, for example, to interface with substantially all the p-type semiconductor layer 20 connected to the p-n junction 24. Layer thicknesses of the p-type semiconductor 20, n-type semiconductor 22, radioisotope 26, cover 30, and protective coating 28 layers may be chosen to optimize the transport properties of the radioisotope emitter and betavoltaic cell, with examples being in the ranges of about 0.1 to 10 micrometers for typical types of alpha radiation and 10 to approximately 100 micrometer for typical types beta radiation (although it is understood that depending on materials and radiation energies the transport distances will vary) as is known to those skilled in the art.

Optimization can be based upon radioisotopes chosen. Photovoltaic cells from materials may be matched to the range of beta particles as an example from S-35, or Tm-171 (it is understood that other appropriate beta radiation sources are also possible), and for example alpha particles from Po-210 radioisotopes (it is understood that other appropriate alpha sources are also possible). The radioisotopes may be coated on respective cells and then the characteristics of the cell's operations including efficiencies, the strengths and weakness of using high energy betas versus high energy alphas, electrical currents and degradation, and like properties used as factors determining optimal characteristics of the semiconductor structure 12.

Suitable wide band-gap materials include, but are not limited to, aluminum nitride, diamond, GaN or SiC. Compared to a silicon based p-n junction, these materials are much more resistant to radiation damage, extending useful life compared to silicon photovoltaic semiconductor structures. Silicon has numerous problems such as its susceptibility to radiation damage, which limits its lifetime. Materials used in embodiments of the invention have inherent wide band-gap energies that range from 1.9 to 6.2 eV and have a high resistance to radiation damage that can even be improved by self-annealing. In addition, the wide band-gap materials exhibit better energy conversion efficiencies than lower band-gap materials. Moreover, the wide band-gap materials used in the present invention generate a larger voltage potential, creating more energy per unit charge.

Optimizations may also be realized by considering additional factors, such as the type of wide band-gap materials used, whether beta or alpha emitters are used, etc. Some example materials capable of use with the present invention include:

SiC betavoltaics with S-35, Tm-171 and Po-210 coatings;

GaN betavoltaics with S-35, Tm-171 and Po-210 coatings;

Diamond betavoltaics with S-35, Tm-171 and Po-210 coatings;

Aluminum nitride betavoltaics with S-35, Tm-171 and Po-210 coatings;

and

Figure 4:
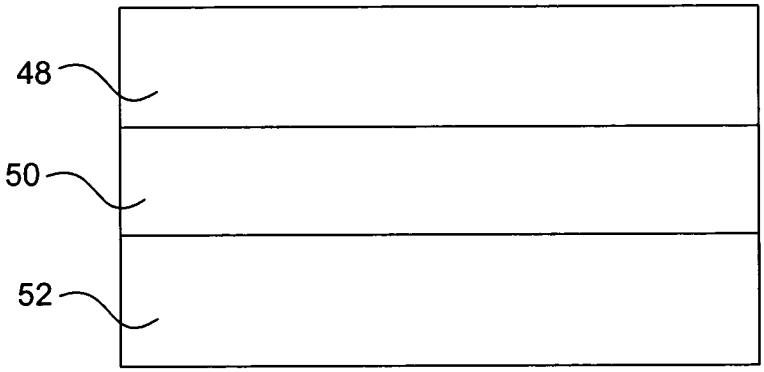
FIG. 4 shows one embodiment of a transmuted radioisotope micro-scale power source.

Diamond betavoltaics formed with S-35 and Tm-171 using transmutation (FIG. 4).

Also, particular wide band-gap materials, namely, aluminum nitride (band-gap 6.2 eV), diamond (band-gap 5.4 eV), GaN (band-gap 3.2 eV) and SiC (band-gap 2.8 eV) match up well with the Xe and Kr excimers for efficient indirect photo conversion. (FIGS. 2 and 3) Other factors include whether an indirect photo conversion method using Kr, Xe or Ar is used as shown in FIGS. 2 and 3.

In one example embodiment, p-type diamond samples doped with 93% enriched boron-10 can be irradiated in the high flux position (thermal neutron flux of $1\times10^{14}$ neutrons per $cm^2$ per second) in a reactor for about 30 days. With a moderate amount of thermal annealing, the diamond films not only recovered, but actually improved in quality. The p-type properties were maintained or enhanced and the Li that was formed in the B-10 (m, alpha)Li-7 reactions was retained in the diamond lattice. Thus, wide band-gap materials can be used in high radiation fields with little degradation. High temperature operation of wide band-gap devices can take advantage of the self-annealing mechanism that occurs.

Figure 2:
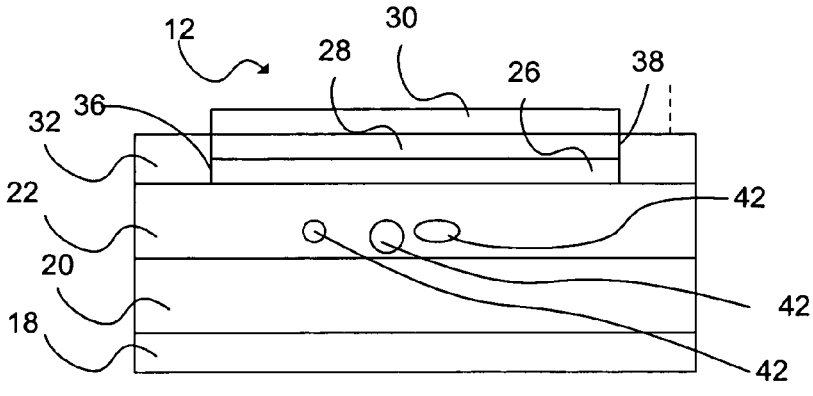
FIG. 2 shows one embodiment of a micro-scale power source having a radiation shield formed as a micro bubble and converting alpha or beta particle energy into narrow band UV photons.
Figure 3:
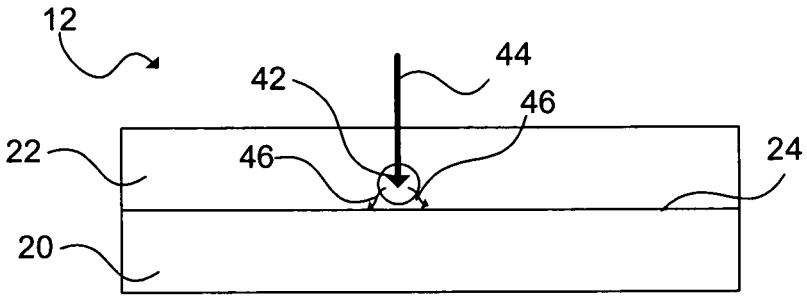
FIG. 3 is another embodiment of a semiconductor structure using an ion beam to self-excite a micro bubble and produce UV photons.

FIG. 2 illustrates a micro bubble 42 formed in the semiconductor structure 12 that performs as a radiation shield. The micro bubble methodology has increased efficiencies and reduces the effects of radiation damage. This semiconductor structure provides a method for converting alpha or beta particle energy into narrow band UV photons that are absorbed by the p-n junction 24.

Some embodiments further comprise a radiation shield for protecting the semiconductor structure from radiation damage. The radiation shield may take any of a number of shapes and configurations, with examples being a protective pattern of multiple bubbles, a layer, or other three dimensional shape made of a material selected to locally change the wide band-gap properties of the semiconductor materials. Moreover, it is contemplated that the micro bubble is not limited to a spherical shape, but can have various shapes depending on selected placement and selection of the ions implanted into the semiconductor structure 12. FIG. 2. illustrates one example radiation shield in the form of plural micro bubbles 42, however it is contemplated that additional micro bubbles can be formed in the semiconductor structure 12.

Micro bubbles can be formed by ion implantation. An ion beam 44 (See FIG. 3) of a given energy deposits ions at a depth which is dependent upon beam energy in the implanted material. If the ions that are used are rare gas atoms, then the micro bubble can have extremely high gas pressures (on the order of several Giga Pascal).

A micro bubble can be formed by bombarding a wide band-gap material (e.g., diamond) lattice with xenon ions. Once formed, the lattice with xenon micro bubbles is irradiated with thermal neutrons. Xe-126 with an abundance of 0.09% and a capture cross section of 3 barns will form Xe-127 (202.9 and 172.1 keV gamma emitter with 36.4 day half life) and Xe-132 with an abundance of 26.89% and a capture cross section of 0.4 barns will form Xe-133 (80.99 keV gamma emitter with 5.243 day half life).

TABLE 2

Some Candidate Radioisotopes

| Nuclide | Z | N | Decay Energy (keV) | Half Life (yr) | Decay |
|---|---|---|---|---|---|
| H-3 | 1 | 2 | 19 | 12.32 | Beta |
| S-35 | 16 | 19 | 167.4 | 0.239 | Beta |
| Ar-42 | 18 | 24 | 600 | 32.9 | Beta |
| Ti-44 | 22 | 22 | 266 | 49.3 | ec, has 94% yield of ~70 keV gammas |
| Fe-55 | 26 | 29 | 232 | 2.73 | Ec |
| Kr-85 | 36 | 49 | 687 | 10.755 | beta .5% yield of 500 keV gammas which cause problems |
| Sr-90 | 38 | 52 | 546 | 28.77 | Beta |
| Ru-106 | 44 | 62 | 39 | 1.0234 | beta Very low Q value of 39 keV - not much energy per decay gamma |
| Cd-109 | 48 | 61 | 184 | 1.2674 | ec 3% yield of 88 keV gamma - stronger than Kr-85 |
| Cd-113 | 48 | 65 | 58 | 14.1 | Beta |
| Sn-121m | 50 | 71 | 6 | 55 | IT - 2% yield 37 keV gamma |
| Pm-145 | 61 | 84 | 161 | 17.7 | ec, alpha 2% 72 keV gamma |
| Pm-147 | 61 | 86 | 225 | 2.624 | Beta |
| Sm-151 | 62 | 89 | 76 | 90 | beta |
| Eu-155 | 63 | 92 | 253 | 4.67 | beta 20-30% 100 keV gamma |
| Tb-157 | 65 | 92 | 63 | 99 | Ec |
| Tm-171 | 69 | 102 | 96 | 1.92 | Beta |
| Hf-178 | 72 | 106 | 2,445 | 31.0 | IT |
| Ta-179 | 73 | 106 | 110 | 1.79 | Ec |
| Pt-193 | 78 | 115 | 56 | 50. | Ec |
| Tl-204 | 81 | 123 | 763 | 3.78 | beta, ec |
| Pb-210 | 82 | 128 | 63 | 22.29 | beta, alpha 4% gamma to 46 keV |
| Po-208 | 84 | 124 | 5,216 | 2.8979 | alpha, ec |
| Po-210 | 84 | 126 | 5,304 | 0.379 | Alpha |
| Ra-228 | 88 | 140 | 46 | 5.75 | Beta |
| Ac-227 | 89 | 138 | 44 | 21.773 | beta, alpha |
| Th-228 | 90 | 138 | 5,520 | 1.9131 | alpha .25% gamma at 216 keV - similar to Kr-85 |
| U-232 | 92 | 140 | 5,414 | 68.9 | Alpha |
| Np235 | 93 | 142 | 123 | 1.085 | ec, alpha |
| Pu-236 | 94 | 142 | 5,867 | 2.857 | alpha, fis |
| Pu-238 | 94 | 144 | 5,593 | 87.74 | alpha, fis |
| Pu-241 | 94 | 147 | 21 | 14.35 | beta, alpha |
| Cm244 | 96 | 148 | 5,902 | 18.1 | alpha, fis |
| Bk248 | 97 | 151 | 5,793 | 9.0 | Alpha |
| Cf250 | 98 | 152 | 6,128 | 13.07 | alpha, fis |

Another embodiment of the invention is a Kr or Xe micro-scale power source, with an example schematically shown in FIG. 3. This embodiment is based on wide band-gap materials and makes use of an indirect photo conversion method in conjunction with excimer formation and emission from a self excited Kr-85 micro bubble 42. A high density Kr or Xe gas micro bubble 42 produces krypton or xenon excimer states that decay, producing photons 46. The photons 46 produce electrical current in a diode (i.e., p-n junction 24) junction. This structure including at least one micro bubble 42 can be used, for example, to limit radiation damage to the p-n junction by absorbing the energy of beta or alpha particles from a radioisotope.

FIG. 3 is a modification of the micro-scale power source of FIG. 2. The modification of FIG. 3 utilizes shielding benefits from a micro bubble 42 like that of FIG. 2, but uses a rare gas radioactive isotope that can self excite the micro bubble and produce photons 46. Similar to FIG. 2, the radioisotope micro bubble 42 of FIG. 3 is useful to help protect the p-n junction 24.

Micro bubbles lead to another variation of the energy conversion process through an indirect photo conversion method where the wide band-gap material is irradiated with vacuum ultraviolet (VUV) light from rare gas excimers created in the micro bubble. One example is to fill the micro bubble with Kr-85 which provides two functions, first as the source of energetic beta particles which secondly excite the Kr-85 gas forming UV photons that irradiate the photovoltaic cell. This provides both a high efficiency conversion mechanism and a means of reducing the potential radiation damage to the p-n junction by using the material in the micro bubble as a shield, as described herein. The photons can then be harvested by the p-n junction using the photovoltaic effect. In this process, Kr-85 is concentrated at high densities. The beta particle released in the Kr-85 decay process interacts with the surrounding Kr-85 atoms to form excited states and ions. At high krypton density, these states preferentially form the krypton excimer state. The excimer then decays by the emission of a photon (around 8 eV) into atomic krypton. The overall efficiency of the conversion process from electron excitation to excimer photon conversion is approximately 50%.

The transport of photons to the photovoltaic cell is an important step in the energy conversion process. The photovoltaic surrounded the Kr excimer photon source and thus the transport can be 100% efficient. If the micro bubble is surrounded by the n-type material, the photons will be absorbed by the material with an efficiency of about 95% or higher.

Preferred embodiments include photovoltaic cells from diamond (band-gap 5.4 eV) and a p-n junction from aluminum nitride (band-gap 6.2 eV). The conversion of photons into electricity using photovoltaic cells has a high intrinsic efficiency of 60 to 80%. The excellent electron and hole mobility and long electron lifetimes of materials such as diamond limit parasitic losses in the photovoltaic conversion process. The overall energy conversion efficiency of this two step energy conversion process is 28 to 38%. Using an ion beam, atoms can be implanted in a small volume within the crystal structure of materials such as diamond or aluminum nitride. This process has been used to create a stress of several Giga Pascal in a diamond crystal in order to change its band-gap properties. This same procedure can be used to create a high pressure micro bubble of Kr or Xe in a diamond or aluminum nitride crystal (FIG. 3). The density of Kr or Xe atoms in the micro bubble can be very high thus limiting the transport distance of beta particles which deposit most of their energy in the Kr or Xe. The excimers formed in the Kr or Xe in turn will produce UV photons which will impinge upon junction material near the micro bubble to generate electrical power with the junction.

Assuming a number of 4 gigapascal Kr-85 "micro bubbles" (e.g., structure in FIG. 3) distributed in a 5 micron deep layer in the device over 1 cm square, the energy deposited by the beta particles in the Kr-85 gas would be approximately 30 milliwatts. Assuming 50% photon production efficiency in the Kr-85 and a 60% photovoltaic conversion efficiency, this yields approximately a 10 milliwatt power source.

FIG. 4 illustrates a use of transmutation to form a radioisotope micro-scale power source. Generally, fabrication occurs by adding first materials to form the radioisotope layer 48, second materials to form the n-type semiconductor material layer 50, and third materials to form the p-type semiconductor material layer 52 in a semiconductor crystal lattice. After a timed exposure to high flux neutrons in a reactor, the semiconductor structures shown in FIGS. 1A-3 can be formed.

More generally, wide band-gap semiconductor materials are defined as those materials with a band-gap greater than 1.9 eV. Wide band-gap materials such as III-V compound semiconductors have many applications in electronics and optoelectronics and especially when formed as microelectromechanical devices. Light emitting diodes (LED's) and lasers are formed of III-V materials in the near infrared and visible emission ranges. III-V nitrides are formed with the potential for emission in the range from visible blue light to UV. The band-gap energies of III-V nitrides, aluminum nitride (AlN), gallium nitride (GaN), and indium nitride (InN), are 6.2, 3.4 and 1.9 eV, respectively. These materials are useful since the AlGaInN quaternary system with a direct band-gap has the potential, especially in optoelectronics, to produce emissions over a wide spectral range from the visible (~650 nm) to the UV (~200 nm). A method of thin film doping, specifically for wide band-gap materials, is provided to produce devices with SiC, GaN, diamond and AlN films.

GaN is a well suited material for optoelectronic applications among all III-V nitrides. The heteroepitaxial growth and doping problem have been two obstacles that had to be overcome for the realization of blue LEDs and lasers made of GaN. Gallium nitride (GaN) substrates are grown by MOCVD, MBE and HVPE. GaN is typically grown on sapphire ($Al_2O_3$), 6H—SiC, and ZnO. Most as-grown GaN (and InN) films exhibited high n-type conductivity due to native defects and p-type conductivity could not be obtained. P-type GaN was achieved by doping with Mg, and GaN p-n homojunction. The alloy of $Al_xGa_{1-x}N$ is also available for blue to UV emitters. However, only films with a small amount of Al (x~0.1 for p-type and x<0.4 for n-type) can be doped successfully.

Aluminum nitride has a very wide band-gap. Also it has a high thermal conductivity, high electrical resistivity, high acoustic velocity, high thermal stability, and high chemical resistance and radiation stability. These properties make AlN suitable for UV optical devices, surface acoustic wave (SAW) devices, electrical insulators or passive layers in microelectronics. Such a device can operate in a harsh environment with high temperatures and/or radiation. However, it is very difficult to dope AlN with impurities to make it to n- or p-type semiconductors. Also, grown AlN films do not show any n- or p-type characteristics.

The properties of wide band-gap materials are superior to silicon. The Keyes figure of merit (KFM) takes into account the power density dissipation for closely packed integrated circuits. High thermal conductivity is an important element for the Keyes figure of merit. Keyes figure of merit is based on $V_{sat}$, $\sigma_t$ (thermal conductivity) and $\in_\Gamma$ (dielectric constant). The relative value of the Keyes figure of merit is the speed of the transistor in the material.

$$KFM=\sigma_t(V_{sat}/\in_\Gamma)^{0.5} \quad (1)$$

TABLE 1

Properties of some wide band-gap semiconductors (From NSM Archive, http://www.ioffe.rssi.ru/SVA/NSM/Semicond/).

| Material | Band Gap eV | $\sigma_t$ ((300K)) ($Wcm^{-1}$) | $\epsilon_r$ | $V_{sat}$ ($cm\ s^{-1}$) | KFM ($W\ cm^{-1/2}\ s^{-1/2}$) | Ratio to Silicon | Mobility electron $cm^2/Vs$ | Mobility hole $cm^2/Vs$ |
|---|---|---|---|---|---|---|---|---|
| Si | 1.1 | 1.5 | 11.8 | $1.0 \times 10^7$ | $13.8 \times 10^2$ | 1.0 | 1450 | 450 |
| GaN | 3.2 | 1.5 | 9.5 | $2.5 \times 10^7$ | $24.3 \times 10^2$ | 1.76 | 300 | 350 |
| αSiC(6H) | 3.0 | 5.0 | 10.0 | $2.0 \times 10^7$ | $70.7 \times 10^2$ | 5.12 | 380 | 40 |
| βSiC(4H) | 3.2 | 5.0 | 9.7 | $2.5 \times 10^7$ | $80.3 \times 10^2$ | 5.8 | 800 | 140 |
| Diamond | 5.4 | 20.0 | 5.5 | $2.7 \times 10^7$ | $444.0 \times 10^2$ | 32.2 | 2200 | 2000 |
| BN | 6.1 | 5.7 | 3.3 | $3.1 \times 10^7$ | $174.7 \times 10^2$ | 12.7 | 200 | 500 |
| AlN | 6.02 | 3.0 | 9.0 | $3.0 \times 10^7$ | $54.8 \times 10^2$ | 4.0 | 135 | 14 |

In betavoltaic power sources of the invention, the wide band-gap materials have good hole and electron mobility and the electron lifetime is very good, especially with GaN, αSiC, βSiC and diamond. This translates into low losses in semiconductor structures and high efficiencies.

Various fabrication techniques may be used to form wide band-gap material semiconductor cells of the invention. These include several wide band-gap materials (e.g., SiC, GaN, diamond and AlN) and several types of structures such as the FIG. 1A cell, the two-step conversion method using a non-radioactive micro bubble (FIG. 2), the two step conversion method using a radioisotope micro bubble (FIG. 3) and the transmutation fabricated cell (FIG. 4). Various suitable substrate materials may be selected.

High quality SiC can be grown by bulk growth methods (4H and 6H structures) as well as by chemical vapor deposition. A p-n structure in SiC can be achieved by various methods.

Gallium nitride substrates can be grown by MOCVD, MBE and HVPE. One of the key issues in GaN technology is a high quality p-type dopant. Both magnesium and beryllium can be used to make p-type GaN. GaN is typically grown on sapphire ($Al_2O_3$), 6H—SiC, and ZnO.

Boron doped HPHT and CVD diamond films can be used as well as type II (a) and type II (b) mined diamond. AlN films can be formed by chemical vapor deposition and thermal decomposition.

In one embodiment, one can form a semiconductor structure by using one of SiC, GaN, diamond and AlN to form the betavoltaic structure of FIG. 1 and apply a two step conversion method using a non-radioactive micro bubble. Alternatively, a transmutation mechanism such as that shown in FIG. 4 may be used, for example, to produce S-35 (beta, 167 keV) from S-34 and to produce Tm-171 (beta, 96 keV) from Er-170. These isotopes are selected due to high specific activity and a good beta energy that can match up well with a particular size scale of a desired electronic circuit.

Another possible method of fabrication is to form a betavoltaic cell using SiC, GaN, diamond and AlN with Po-210 (alpha, 5,340 keV). High temperatures may be used in some embodiments to provide a self-annealing recovery mechanism of the materials. With these substrates, the p-n junctions are formed, and the appropriate contact material (Ti, Mo and Ta for diamond, gold for SiC, GaN and AlN) is sputtered to form the electrodes.

Alternate methods are available for depositing the radioisotope. One method is to put a layer of the isotope on the betavoltaic cell (FIG. 1A). A second method is to use transmutation, as shown in FIG. 4. A protective coating can be applied through deposition, for example CVD.

The type of junction provides different embodiments, for example SiC, GaN, diamond and AlN diode embodiments. Doping to form n- and p-type layers is by appropriate impurities using a Field Enhanced Diffusion with Optical Activation (FEDOA) method to dope diamond films to make them either n- or p-type semiconductors and to purify and dope silicon carbide and gallium nitride. Diamond, like AlN, experiences a problem with doping, specifically for n-type. However, n-type behavior in diamond can be implimented by using the FEDOA method.

FEDOA is proven to be a viable method of doping wide band-gap materials. Moreover, the method has been used for the fabrication of a Li and B doped single crystal diamond p-n junction. One of the difficulties of doping a wide band-gap material is getting atoms to move through the crystal lattice. FEDOA achieves this result in diamond, which has very small lattice spacing. However, the lattice spacing in AlN is larger than that of diamond and the energetics of AlN are similar to that of diamond. Therefore, doping of AlN by the FEDOA method is easier than doping diamond.

Diffusion and ion implantation are the major post-processing methods for introducing impurities in microelectronic fabrication. An advantage of diffusion is that it neither creates new defects nor destroys the lattice structure in semiconductors. The FEDOA diffusion method is based on use of additional driving forces to make diffusion more effective.

Figure 5:
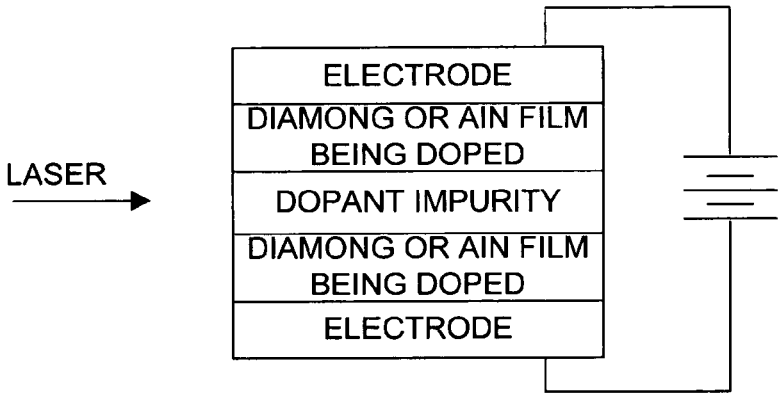
FIG. 5 shows formation of n- and p-type semiconductor layers by doping them with various impurities using a Field Enhanced Diffusion with Optical Activation (FEDOA) method.

A Field Enhanced Diffusion with Optical Activation method (FEDOA) is illustrated in FIG. 5. A dopant is placed between two diamond films, mounted on a graphite base with an imbedded tungsten heater. An electric field is applied using two electrodes in contact with the diamond films. Thus, positive ions experience a Lorentz force that causes the ion to drift to a negative pole while negative ions move to a positive pole, and therefore the impurities are introduced into the semiconductors with the field enhancement.

Radiation damage of various materials is one problem needed to be overcome. P-type diamond doped with 93% enriched boron-10 was irradiated in the high flux position (thermal neutron flux of $1\times10^{14}$ neutrons per $cm^2$ per second) of a reactor with a thermal neutron fluence of $2.6\times10^{20}$ n/$cm^2$ and a fast neutron fluency of $3.2\times10^{19}$ n/$cm^2$. The $^{10}B(n, Li)\alpha$ interaction was used to transmute boron impurities into lithium for the purpose of creating n-type diamond. Samples were exposed to a wide range of radiation including thermal and fast neutrons, gammas, energetic alpha and energetic lithium particles. The diamond films were examined and the damage evaluated. It was discovered that with thermal annealing at 575° C. for 30 minutes, the films not only recovered, but actually improved in quality (See FIG. 6). The p-type properties were maintained or enhanced and the Li that was formed in the B-10(n, alpha)Li-7 reactions was retained in the diamond lattice. It is believed that the displacement radiation transformed planar and volume defects into point defects which were easily annealed thus improving the quality of the diamond. Thus, wide band-gap materials can be used in high radiation fields with little degradation. High temperature operation of wide band-gap devices can take advantage of the annealing characteristic of the material.

The critical radiation damage mechanisms are the formation of defects in the cell structure. Consideration of these effects aids in determining the optimum beta source for maximizing both device efficiency and radiation hardness.

Figure 6:
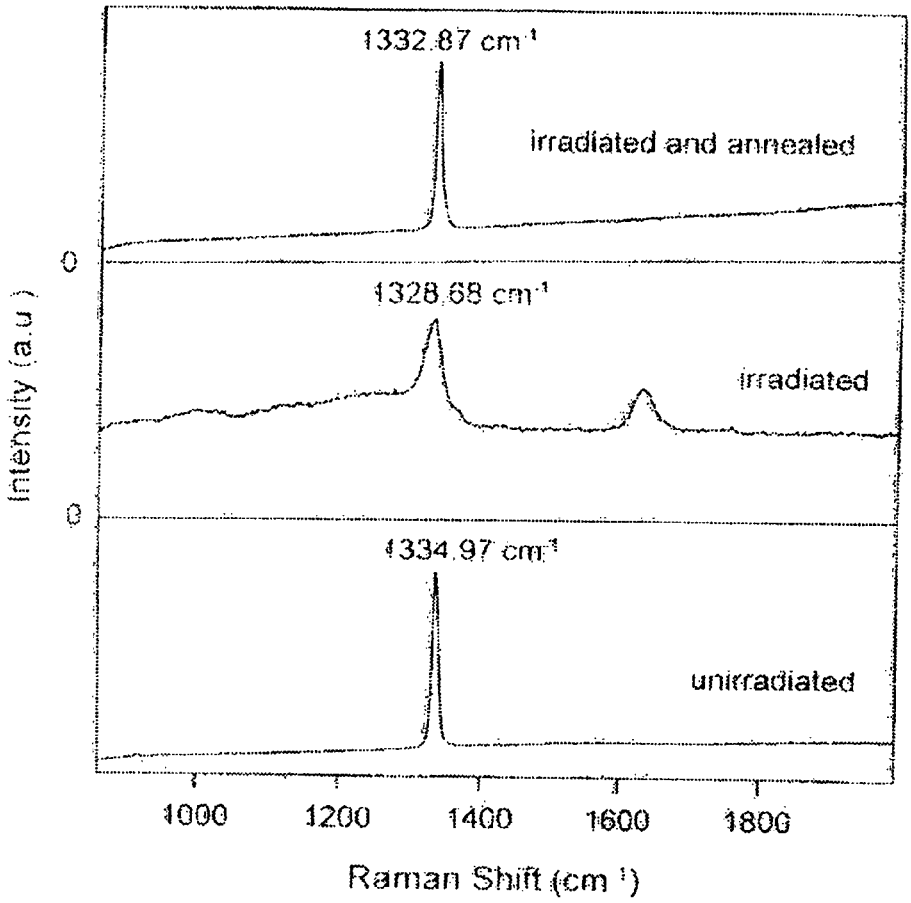
FIG. 6 shows a random spectrum of unirradiated, irradiated, and "irradiated and annealed" p-type diamond.

The use of a micro bubble in the two step conversion process shown in FIGS. 2 and 3 shields the p-n junction from radiation damage. The shield effect of a micro bubble is substantial. For the following isotopes, a range of the beta or alpha particles is:

S-35 (167.4 keV)-3 microns
Tm-171 (96 keV)-1 micron
Kr-85 (687 keV)-15 microns
Po-210 (5,304 keV) alphas-0.3 microns The shielding effect of a micro bubble protects the p-n junction to enhance its lifetime. FIG. 6 shows a typical Raman spectrum of an unirradiated, irradiated and irradiated and annealed p-type diamond sample.

Figure 7:
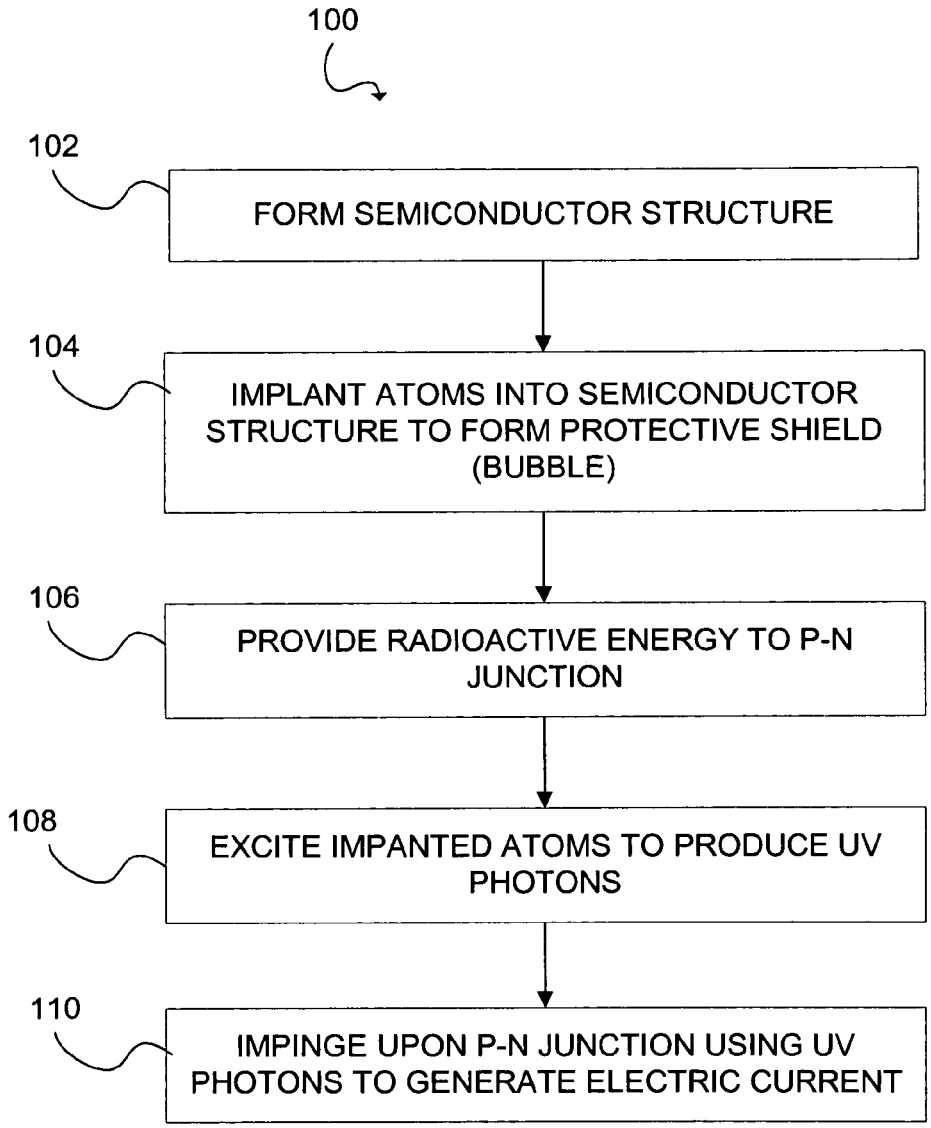
FIG. 7 is a flow chart showing a method of forming a radiation shield in a semiconductor structure.

Turning now to FIG. 7, a flow chart of a method of forming a power source is shown generally as 100. The method 100 includes the step 102 of forming a semiconductor structure having a p-n junction of wide band-gap materials. In step 104, atoms are implanted in the semiconductor structure to form at least one micro bubble. Radioactive energy is provided to the p-n junction in step 106, such that the implanted atoms are excited to produce UV photons (step 108) in the micro bubble. In step 10, the UV photons impinge upon the p-n junction to generate electrical power. The method of forming the power source can use rare gas ions, such as Kr or Xe, as implantation atoms. However, it is envisioned that many of the materials discussed herein can be adapted for use with the present invention.

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

The invention claimed is:

1. A micro-scale power source, comprising:

a semiconductor structure having a p-n junction formed of wide band-gap materials;

a radioisotope providing energy to said p-n junction; and a radiation shield located within said semiconductor structure, wherein said radiation shield comprises a high density rare gas radioactive isotope micro bubble, wherein said high density causes excimer states in the rare gas radioactive isotope that decay to produce photons.

2. A micro-scale power source, comprising:

a semiconductor structure having a p-n junction formed of wide band-gap materials;

a radioisotope providing energy to said p-n junction; and a radiation shield located within said semiconductor structure, wherein said radiation shield comprises implanted atoms defining a high density rare gas micro bubble that is a small volume within said semiconductor structure having a locally changed band-gap, wherein said high density causes excimer states in the rare gas that decay to produce photons.

3. The power source of claim 2, wherein the p-n junction is formed from the group consisting of doped aluminum nitride, diamond, GaN or SiC.

4. The power source of claim 2, the p-n junction being formed on a first contact, the radioisotope formed on an opposite side of the p-n junction, further comprising a protecting coating on the radioisostope, and a second contact on the opposite side of the p-n junction.

5. The power source of claim 4, integrated in a MEMS device, the first and second contacts being part of a connection pattern in the MEMS device.

6. The power source of claim 2, wherein the radioisotope is formed as a thin layer.

7. The power source of claim 2, wherein said radioisotope is supported on an upper surface of said p-n junction, and wherein the power source further comprises:

a first contact underlying said p-n junction opposite from said radioisotope; and, a second contact on said upper surface of said p-n junction and surrounding a perimeter of said radioisotope.

8. The power source of claim 7 and further comprising a protective coating layer over said radioisotope, said second contact surrounding the perimeter of said coating layer.

9. The power source of claim 8 and further comprising a cover over said protective coating layer, said cover not extending over said second contact and wherein a top surface of said second contact layer remains exposed.

10. The power source of claim 2, wherein said micro bubble is non-radioactive.

11. A micro-scale power source, comprising:

a semiconductor structure having a p-n junction formed of wide band-gap materials;

a radioisotope providing energy to said p-n junction; and a radiation shield located within said semiconductor structure, wherein said radiation shield comprises a high density micro bubble filled with one of Kr or Xe, wherein said high density causes excimer states in the KR or Xe that decay to produce photons.

12. A method of forming a power source, comprising the steps of:

forming a semiconductor structure having a p-n junction of wide band-gap materials;

implanting rare gas atoms in said semiconductor structure to form a micro bubble having high gas pressure defining a small volume of locally changed band-gap, wherein said gas pressure creates high density of the rare gas atoms sufficient to cause excimer states in the rare gas atoms that decay to produce photons; and providing radioactive energy to said p-n junction, wherein said implanted atoms are excited to produce photons in said micro bubble, said photons impinging upon said p-n junction to generate electrical power.

13. The method of forming a power source of claim 12, wherein said implanting atoms step comprises implanting rare gas ions under several Giga Pascal of pressure.

14. The method of forming a power source of claim 13, wherein said rare gas ions comprise one of Kr and Xe.

15. The method of claim 12, wherein said photons comprise UV photons.

* * * * *